United States Patent [19]

Treanor et al.

[11] Patent Number: 5,018,697

[45] Date of Patent: May 28, 1991

[54] OBJECT HANGER FOR DRYWALL

[76] Inventors: David H. Treanor; Tracy B. Treanor, both of 1508 E. 21st, Cheyenne, Wyo. 82001

[21] Appl. No.: 463,510

[22] Filed: Jan. 11, 1990

[51] Int. Cl.[5] ..... A47G 1/16

[52] U.S. Cl. ..... 248/547; 248/489

[58] Field of Search ..... 248/547, 489, 497, 498, 248/493, 475.1

[56] References Cited

U.S. PATENT DOCUMENTS

| | | | |
|---|---|---|---|
| 769,794 | 9/1904 | Fowler | 248/489 |
| 1,272,696 | 7/1918 | Molk | 248/489 |
| 1,292,956 | 1/1919 | McConnal | 248/489 |
| 1,339,703 | 5/1920 | Green | 248/493 |
| 1,675,281 | 6/1928 | Strand | 248/489 |
| 2,049,716 | 8/1936 | Owen | 248/489 |
| 2,526,827 | 10/1950 | Peters | 248/489 |
| 2,940,712 | 6/1960 | Lloyd-Young | 248/489 |
| 3,063,669 | 11/1962 | Bell | 248/489 |
| 3,343,773 | 9/1967 | Lorenz | 248/489 X |
| 3,861,631 | 6/1975 | Shorin | 248/489 |
| 3,912,211 | 10/1975 | Topf | 248/489 |
| 4,606,526 | 8/1986 | Rabinowitz | 248/489 |
| 4,729,537 | 3/1988 | Turner et al. | 248/547 |

FOREIGN PATENT DOCUMENTS

| | | | |
|---|---|---|---|
| 446962 | 12/1912 | Fed. Rep. of Germany | 248/489 |
| 823028 | 1/1938 | France | 248/489 |

*Primary Examiner*—Alvin C. Chin-Shue

*Attorney, Agent, or Firm*—Dean P. Edmundson

[57] ABSTRACT

A hanger for suspending objects (framed pictures, knickknacks) for use on building interior wall surfaces of semi-permeable composition such as drywall. The hanger attaches to drywall by a straight pin instead of nails or screws, thereby dramatically reducing the hole size remaining when the hanger is removed. The hanger includes a body connected to a hanger inserter by a hinge. A pin is inserted in an aperture formed through the body. The head of the pin is positioned in a channel created by a recessed U-shaped arcing groove in the inserter. The groove has a concave curvature matching the convex curvature of the pinhead. By applying force to the inserter push surface, the inserter rotates downward about the hinge and the pin penetrates the drywall. The hanger is used for suspending objects on a wall surface. The hanger is removed by pulling upward and away from the wall by gripping the body side surfaces.

7 Claims, 2 Drawing Sheets

OBJECT HANGER FOR DRYWALL

BACKGROUND

1. Field of Invention

This invention relates to devices designed to mount lightweight objects by suspending them (framed pictures, knickknacks) or affixing them (posters, charts, maps) on semi-permeable walls. The invention takes advantage of the unique material qualities of the interior building material known by the trade names gypsum wallboard, sheetrock, or drywall (referred to as drywall the remainder of this application). In the following specifications the term "object hanger" is used in reference to the mounting devices proposed for both suspending and affixing objects to drywall.

2. Description of Prior Art

Heretofore, object hangers have been designed to be secured to walls by nails or screws. Upon removing the hanger, the resulting hole would be substantial and unsightly, even when using small nails, tacks, or screws. Further, prevalent object hangers are limited to hanging objects by a wire, string or thread attached to the object and suspended from a grooved hanger. This leaves no provision for those objects with a slot, hole, or ledge recessed in the object. U.S. Pat. No. 4,606,526 to Rabinowitz (1986) provides projections for engaging frames with channels projecting outward from the back of and running the length of the frame. This device is limited because the vertical projections on the hanger are incapable of fitting into a recessed channel requiring the support of an inclined projection.

Mounting devices have been designed in consideration of drywall's firm, yet penetrable composition. U.S. Pat. No. 3,861,631 to Shorin (1973) employed the use of a cruciformed plastic nail providing more surface area to support the weight of the object to be suspended. U.S. Pat. No. 2,940,712 to Lloyd-Young (1958) proposed two interlocking nails driven in at differing angles to insure the object did not tear out from the wall under the weight of the object to be hung. In both these devices, substantial damage occurs from securing the wall hanger to the drywall. In addition, all other suspending devices require the use of a driving object to insert the nail, most commonly a hammer. These driving tools are necessary due to the relatively large cross section diameter of the nails used and the variety of walls the hangers can be applied to.

In short, all the mounting devices heretofore known suffer from a number of disadvantages, namely:

(a) Nails or screws are used to secure prior object hangers to walls. These hangers rely solely on the sheer strength and moment resisting properties of the nail or screw to support the weight of the object. As a consequence, the nail or screw must be of substantial cross section to support the object, leaving relatively large and unsightly holes when the hangers are removed.

(b) The noticeable holes remaining when these object hangers are removed require spackling and repainting to eliminate the disfigurement—a bothersome job in the least.

(c) The user must obtain either a hammer or screwdriver to install previous wall hangers. In the case of the screwdriver, the user must also assure that the screwdriver head is of an appropriate size for the screw used.

(d) To affix the majority of object hangers to drywall, a user must have some skill in using either a hammer or a screwdriver. Hammers frequently smash exposed fingers when driving a small nail home. Additionally, care must be exercised to keep from either banging the wall with the hammer or slipping off the head of the screw and marring the wall with a screwdriver.

(e) Prior object hangers have been designed either to hang objects from a wire, or to hang pictures with a frame designed with a long channel protruding from the frame, but not both. None of the prior art object hangers reviewed to date make provision for those objects with recessed slots, ledges, or holes requiring a protruding projection.

(f) Prior hanger designs depend on the user inserting the nail at a strong point on the wall, preferably into a hidden load bearing member the drywall is attached to (referred to as a "stud"). Often, in the process of locating such a hidden member, a user inserts the hanger at many places, thereby increasing the unsightliness of the job. Additionally, if the user does not like the placement of the object and moves it several times to find the most aesthetic placement, the resulting unsightly holes greatly reduce the overall beauty of the wall.

(g) If an object hanger is affixed to a hidden stud and a user desires to move the object from the present position, removing the hanger from the wall can be quite difficult. A lever must be located to remove the nail, often marring the drywall in the process.

(h) Some object hanger designs situate the insertion of the nail or screw affixing the hanger above the level on the hanger the object is suspended from. This design often results in exposing a portion of the hanger once the object is hung.

OBJECTS AND ADVANTAGES

Accordingly, several objects and advantages of the present invention are:

(a) to provide a method of fastening an object hanger to drywall without using a fastening component of substantial diameter. The goal is the design of a hanger which employs both sheer strength and moment resisting properties in a complimentary manner, thereby reducing the size of the affixing member. This would eliminate the relatively large diameter hole remaining when the hanger is removed.

(b) to eliminate the need to spackle or paint the area where the hanger was affixed to the drywall by reducing the damaged area caused by the member used to affix the hanger to the wall.

(c) to eliminate the need for a user to locate tools such as a hammer or screwdriver to insert a nail or screw driver previously used to affix prior object hangers to drywall.

(d) to improve the ease of installing the object hanger by not requiring the use of a hammer or screwdriver. Additionally, the common mishaps of smashed fingers and/or marred drywall would be completely eliminated.

(e) to provide an object hanger accounting for the various methods of mounting an object, be it by looping a wire, string or thread connected to the object over a groove on the hanger, or by engaging a cylindrical projection extending from the hanger into a complimentary ledge, slot, or hole built into the object to be hung.

(f) to eliminate the need for a user to locate a load bearing "stud" to support the weight of a given object by employing the concepts of sheer and moment in a complimentary fashion.

(g) to reduce the effort and eliminate the need for tools to remove the object hanger from the wall. Not requiring hammers and screwdrivers to remove nails and screws eliminate the possibility of marring the drywall in the process.

(h) to provide a hanger which is easily hid behind the object to be suspended by securing the hanger to the drywall at a location just below the level the object is hung from.

Still further objects and advantages will become apparent from a consideration of the ensuing description and drawings.

DRAWING FIGURES

In the drawings, closely related figures have the same number but different alphabetic suffixes.

REFERENCE NUMERALS IN DRAWINGS

Similar parts on the hanger embodiment are numbered identically to those on the tack embodiment. Only those items differing substantially in form on the tack embodiment are assigned a new number.

10—integrally molded hinge
12—hanger body
14—hanger inserter
16—body inclined surfaces (a,b)
18—inserter inclined surface
20—V-shaped groove
22—prong grooves (a,b,c)
24—tapering cylindrical prong
26—inserter push surface
28—U-shaped arcing groove
30—inserter channel
32—lower (a)-upper (b) body and inserter internal surfaces
34—pin shank
36—aperture
38—pinhead landing
40—pinhead
42—drywall
44—pinpoint
46—gripping ridges (a,b)
48—side surfaces (a,b)
F—applied force
52—tack body
54—tack inserter

DESCRIPTION—FIGS. 1 to 4

Figure 1:
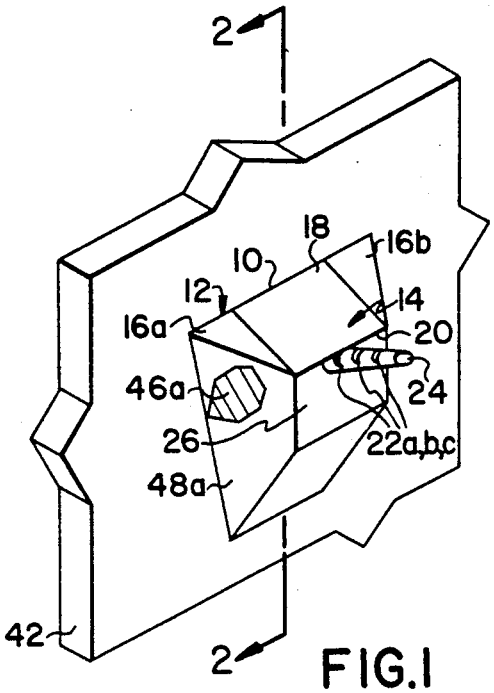
FIG. 1 is a perspective view of an object hanger used to suspend objects (framed pictures, knickknacks).

FIG. 1 shows a perspective view of the object hanger embodiment proposed in this application. The invention is made of hard yet flexible plastic that can be repeatedly bent without fracturing. A hanger body 12 and a hanger inserter 14, composing the two main parts of the invention, are connected at an integrally molded hinge 10. Located at the top and to both sides of body 12 are body inclined surfaces 16*a, b*. Likewise, located on inserter 14 is inclined surface 18. A tapering cylindrical prong 24 protrudes from inserter 14 outward above an inserter push surface 26. Prong grooves 22*a, b, c* are spaced evenly along prong 24. Inserter inclined surface 18 and prong 24 meet to form a V-shaped groove 20. The hanger is attached to drywall 42. A set of gripping ridges 46*a, b* are located on side surfaces 48*a, b*.

Figure 2:
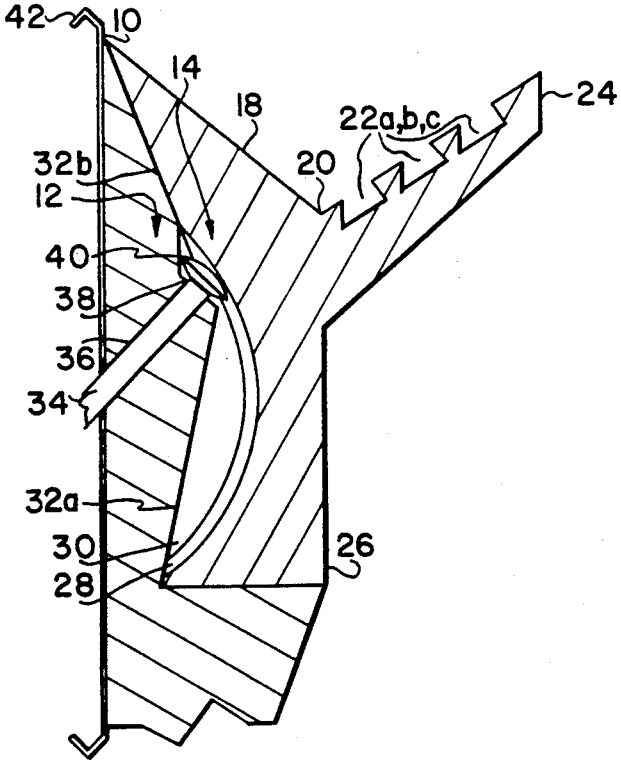
FIG. 2 is a cross section of the perspective drawing in FIG. 1. Included is a depiction of the final position of a straight pin (shown foreshortened and not in cross section) used to affix the hanger.
Figure 4:
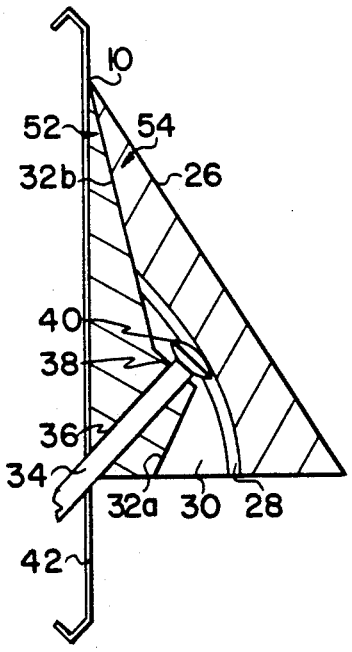
FIG. 4 is a cross section of the perspective drawing in FIG. 3. Included is a depiction of the final position of a straight pin (shown foreshortened and not in cross section) used to affix the hanger.
Figure 5A:
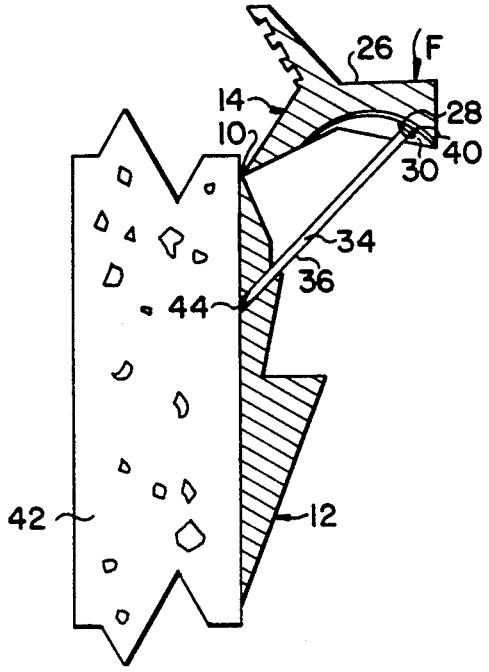
FIG. 5 shows (a) the initial position of the inserter and straight pin and (b) a drawing showing the pin partially inserted.
Figure 5B:
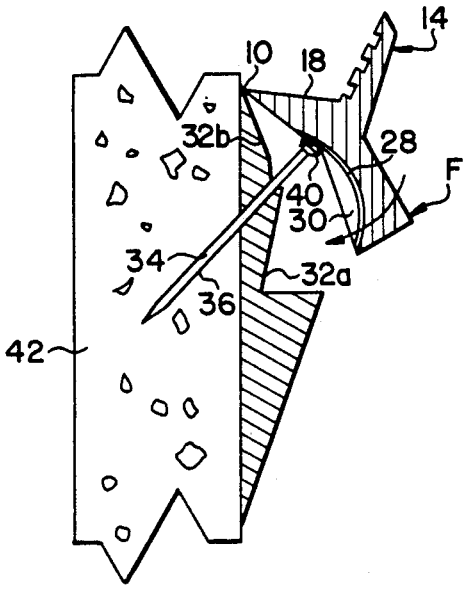
Figure 6A:
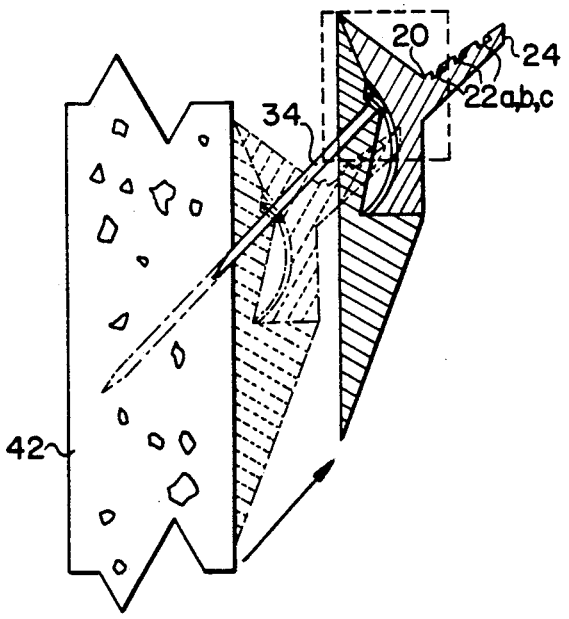
FIG. 6 is a cross section drawing illustrating (a) the hanger embodiment in the fully installed position (phantom lines) and as it is almost removed from the drywall; (b) is an enlarged area showing small details more clearly.
Figure 6B:
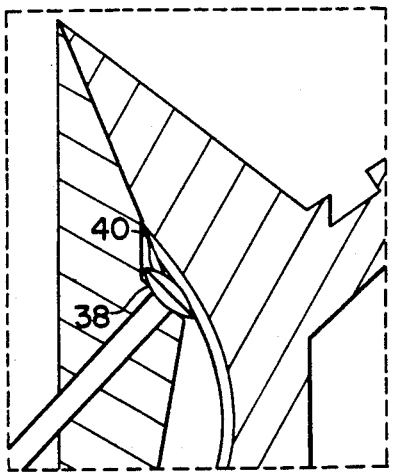

FIG. 2 is a cross section view showing the object hanger internal components. Body 12 and inserter 14 are connected at hinge 10 and meet where lower and upper body and inserter internal surfaces 32*a, b* coincide. An aperture 36 provides a pin shank 34 access to drywall 42 through body 12. At the top of aperture 36 is a pinhead landing 38. Internal to inserter 14 is an inserter channel 30 and U-shaped arcing groove 28, both the width of pinhead 40. U-shaped arcing groove 28 has a concave curvature matching the convex curvature of pinhead 40. Not shown in the figure is the pinpoint 44 located on pin shank 34 (FIG. 5 and 6).

Figure 3:
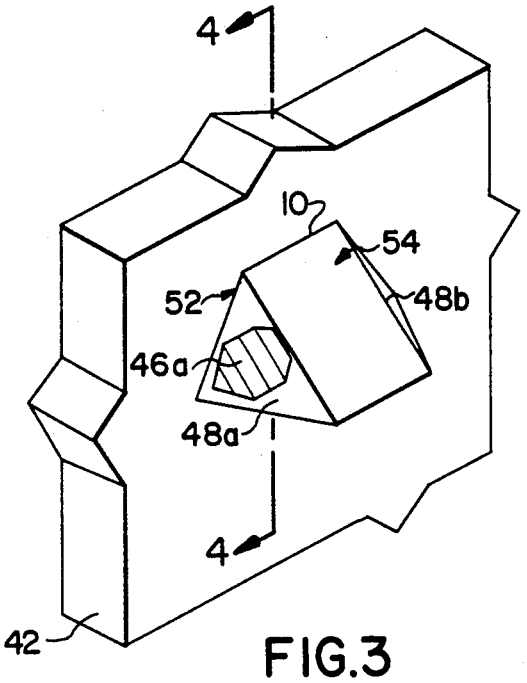
FIG. 3 is a perspective view of an embodiment used as a tack for affixing objects (posters, charts, maps).

FIG. 3 is a perspective view of a tack embodiment of the invention proposed in this application. It is made of durable and flexible plastic that can be repeatedly bent without fracturing. It is designed for affixing objects to drywall versus suspending them. Similar to the object hanger, the device is composed of two primary parts, a tack body 52 and a tack inserter 54 connected at integrally molded hinge 10. Gripping ridges 46*a, b* are located on side surfaces 48*a, b*. Shown in cross section in FIG. 4, the body 52 and inserter 54 are connected at hinge 10 and meet where lower and upper internal body and inserter surfaces 32*a, b* coincide. Beginning at the top of pinhead landing 38 is aperture 36 which provides pin shank 34 access to drywall 42 through body 52. Internal to inserter 54 is channel 30 and U-shaped arcing groove 28, both the width of pinhead 40. U-shaped arcing groove 28 has a concave curvature matching the convex curvature of pinhead 40.

On the wall hanger invention, body 12 is typically 3.2 centimeters (1.25 inches) long. The combination of body 12 and inserter 14 extends 1.27 centimeters (0.5 inches) to the furthest point from drywall 42. U-shaped arching groove 28 is designed to transmit an inserting force (applied at the inserter push surface 26) approximately along the centerline axis of pin shank 34. On the tack embodiment, body 52 is typically 1.27 centimeters (0.5 inches) long. The combination of body 52 and inserter 54 extend 0.85 centimeters (0.375 inches) to the furthest point from drywall 42. U-shaped arcing groove 28 is similarly designed to transmit an inserting force (applied at the inserter push surface 26) approximately along the centerline axis of pin shank 34. On both embodiments, the straight pin length is 1.9 centimeter (0.75 inches) from point to top of pinhead.

From the description above, a number of advantages of my object hanger become evident:

(a) the principles of sheer and moment are implemented in a complementary fashion providing for the support of a substantial weight despite the small diameter of the straight pin. The straight pin diameter is only a fraction of the size caused by commonly used nails, tacks, or screws (from one-fourth to one-twentieth the diameter of commonly used nails).

(b) because of the significantly smaller pin diameter, the hole remaining after removing the hanger is so small as to be imperceptible. Consequently, spackling and painting the drywall is unnecessary to repair otherwise unsightly hole damage.

(c) the method of inserting the straight pin is built into the object hanger and obviates the need for locating a hammer to drive a nail or screwdriver to insert a screw to affix the hanger to the drywall.

(d) because a hammer or screwdriver is not required to insert a nail or screw to affix the hanger, the possibility of smashed fingers or marred walls is completely negated.

(e) the hanger accounts for several methods of mounting objects by providing a groove for hanging by a wire, string or thread as well as a cylindrical prong for those objects with either a ledge, slot, or hole built into the object.

(f) because the engineering principles of sheer and moment are balanced in the design of the body and the location of the pin, no need for a supporting medium beyond that provided by the drywall is necessary. The weight of the object to be mounted is supported in both sheer and moment, and the user need not make special efforts to insure the hanger is affixed to hidden wall support members.

(g) as the pin shank is polished and smooth, a lever or screwdriver is not required to remove the object hanger from the drywall. The hanger need only be pulled upward and away from the wall to move it to another location.

(h) the object hanger is designed so that it will not be exposed once an object has been suspended from it.

Operation—FIGS. 5 and 6

In the following description, the operation of the hanger and tack embodiments are very similar. The insertion and removal of both devices is combined by including numbers for similar parts of the tack embodiment in parenthesis immediately following the object hanger number designator, for example: ". . . the inserter 14 (54) . . . "

Insertion. The manner of using the hanger described above is similar to current hangers in some aspects, and different in others. The object hanger is placed at a point on drywall 42 where the object is to be mounted (see FIG. 5*a*). Inserter 14 (54) is swung upward about integrally molded hinge 10 to access aperture 36 located on body 12 (52). Pin shank 34 of a straight pin is inserted into aperture 36 until pin point 44 comes in contact with drywall 42. The user swings inserter 14 (54) downward about hinge 10 until pinhead 40 enters inserter channel 30 and comes in contact with U-shaped arcing groove 28. At this stage, pin point 44 is located at drywall 42 surface, ready to be inserted. The user then applies enough force F at inserter push surface 26 to cause pin point 44 to penetrate drywall 42. By continuing to apply force F, inserter 14 (54) rotates about hinge 10 causing pinhead 40 to glide over U-shaped arcing groove 28. At the same time, pin shank 34 travels through aperture 36 as pin point 44 continues to penetrate drywall 42. The portion of pin shank 34 not in aperture 36 is prevented from moving laterally by inserter channel 30, thereby increasing the stability of the insertion. Inserter 14 (54) continues to rotate about hinge 10 until upper and lower body and inserter internal surfaces 32*a, b* meet and stop the progress of inserter 14 (54). When using the hanger embodiment, a looping member (such as a wire, string, or thread) connected to the the object to be suspended is applied at V-shaped groove 20 or the cylindrical prong 24 is inserted into a slot, hole, or ledge supplied for this purpose on the object. When using a wire, string, or thread to suspend the object, inclined surfaces 16*a, b* on body 12 and inclined surface 18 on inserter 14 insure that the looping member is guided to V-shaped groove 20 and is secure in that location. Additionally, prong grooves 22*a, b, c* engage the looping member used to hang the object to ensure the loop does not inadvertently slide off the prong.

Removal. To remove the object hanger from drywall 42, the hanger is grasped at side surfaces 48*a, b* and pulled upward and away from drywall 42, making use of gripping ridges 46*a, b*. Because pin shank 34 has a polished surface the resistance to pulling the pin out is minimal. As the hanger is removed from drywall 42, pinhead 40 lodges against pinhead landing 38 (see detail in FIG. 6*b*). The pin is thereby removed from drywall 42 as the hanger is removed.

SUMMARY, RAMIFICATIONS, AND SCOPE

Accordingly, the reader will see that the mounting devices proposed in this application can be used to hang or affix objects easily and conveniently. Also, they can be removed just as easily and with significantly less damage to the drywall than possible in other hangers. Furthermore, the object hanger and tack described above have specific additional advantages in that:

- they provide for a dramatic reduction in the diameter of the hole necessary compared to other devices used to support objects on drywall (one-fourth to one-twentieth the size of commonly used nails or screws).
- there is no need to spackle and paint the drywall because the hole remaining after removing the hanger is so small as to be imperceptible.
- these devices eliminate the necessity of finding a hammer or screwdriver to affix the hanger to the drywall resulting in a much easier and quicker installation process.
- because a hammer or screwdriver is not required, the possibility of smashed fingers or marred drywall caused by missing the head of the nail or slipping off the head of a screw is totally eliminated.
- the object hanger provides for suspending objects by a wire, string, or thread as well as from a ledge, slot, or hole located in the object.
- the hanger provides for suspending objects of substantial weight through a balanced design using the sheer strength of the straight pin in combination with the moment resisting hanger design. Because of these sheer and moment properties the object hanger need not be affixed to a more stable support medium (such as a hidden stud) than the drywall itself.
- little exertion is necessary to remove the hanger from the drywall because of the polished pin shank. No tools are needed to remove the hanger from the wall.

by affixing the hanger to the wallboard at a point lower than the level the object is hung, the possibility of the object hanger being exposed to view is eliminated.

Although the description above contains many specificities, these should not be constructed as limiting the scope of the invention but as merely providing illustrations of some of the presently preferred embodiments of this invention. For example, the hanger fixture could be of greater length, thus providing a greater resisting moment arm; the hanger inserter part could be designed with a prong protruding further or less further from the wallboard; the hanger could be designed to have more than one pin used to penetrate the wall, thus increasing the weight bearing capacity of the hanger; the "hanger" could be used to affix or mount objects on materials other than drywall, etc.

Thus the scope of the invention should be determined by the appended claims and their legal equivalents, rather than by the examples given.

I claim:

1. A device for mounting an object on a semi-permeable material, said device comprising in combination:

(a) a straight pin comprising a shank member having a first end which is pointed and a second end which includes a head member;

(b) a body member including front and rear surfaces; wherein said rear surface comprises a planar surface for abutment against said semi-permeable material, wherein said body member includes side surfaces and a set of gripping ridges formed in each said side surface; wherein said front surface comprises a recessed area; wherein said body member further includes an aperture extending through said body for receiving said straight pin and enabling said pin to access said semi-permeable material; wherein said aperture has a diameter slightly greater than said shank member of said pin; wherein said aperture extends generally at a forty-five degree angle with respect to said planar surface; said body member further including a landing located at the top of, and inclined in a plane perpendicular to, the centerline of said aperture for stopping the travel of said pin through said aperture by engaging said head member; and (c) an inserter member which is hingedly attached to said body member at a connection and is movable against said head member of said pin to cause said pin to penetrate said semi-permeable material; wherein said inserter member is received in said recessed area in said body member.

2. The mounting device of claim 1 wherein said body member and said inserter member comprise plastic.

3. The mounting device of claim 1 wherein said body member is elongated, and wherein a portion of said planar surface of said body member extends below said aperture to provide a moment arm capable of resisting the moment caused by suspending an object from said device.

4. The mounting device of claim 1 wherein said inserter member is comprised of:

(a) a complimentary shape for fitting into said recessed area of said body member;

(b) an external surface at which a force may be applied as means to cause said inserter member to rotate about said connection;

(c) a channel means for increasing the lateral stability of the insertion of the pin and being formed by a recessed U-shaped arcing groove as means to transmit said force applied at said inserter external surface in a direction approximately along the central axis of said pin to cause said head member of said pin to glide along the groove whereby as said pin is positioned in said aperture through said body member, said head member of said straight pin is positioned in said channel and communicates with said U-shaped arcing groove, said force being applied to said external surface, said inserter member rotates about said connection and the pin is inserted into said semi-permeable material thereby attaching said device to said semi-permeable material.

5. The mounting device of claim 4 wherein said inserter further includes:

(a) a V-shaped groove, said V-shaped groove being formed by the junction of a downward incline from the top of said device and (b) a prong extending outwardly from said external surface;

(c) a plurality of grooves located on said prong.

6. The mounting device of claim 1 further including a plurality of apertures, channels and recessed U-shaped arcing grooves and a plurality of straight pins.

7. A device for mounting an object on a semi-permeable material, said device comprising in combination:

(a) a straight pin comprising a shank member having a first end which is pointed and a second end which includes a head member;

(b) a body member including front and rear surfaces; wherein said rear surface comprises a planar surface for abutment against said semi-permeable material, wherein said front surface comprises a recessed area; wherein said body member further includes an aperture extending through said body for receiving said straight pin and enabling said pin to access said semi-permeable material; wherein said aperture has a diameter slightly greater than said shank member of said pin; wherein said aperture forms an acute angle with respect to said planar surface;

(c) an inserter member which is hingedly attached to said body member at a connection and is movable against said head member of said pin to cause said pin to penetrate said semi-permeable material; wherein said inserter member is received in said recessed area in said body member.

* * * * *